US008821361B2

(12) United States Patent
Nemoto et al.

(10) Patent No.: US 8,821,361 B2
(45) Date of Patent: Sep. 2, 2014

(54) CENTRIFUGAL SEPARATOR AND SWING ROTOR FOR CENTRIFUGAL SEPARATOR

(75) Inventors: Kenichi Nemoto, Ibaraki (JP); Hiroshi Hayasaka, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 743 days.

(21) Appl. No.: 13/012,663

(22) Filed: Jan. 24, 2011

(65) Prior Publication Data

US 2011/0183829 A1 Jul. 28, 2011

(30) Foreign Application Priority Data

Jan. 25, 2010 (JP) ..... 2010-012812

(51) Int. Cl.
*B04B 5/04* (2006.01)

(52) U.S. Cl.
USPC ..... 494/20; 422/548

(58) Field of Classification Search
CPC ..... B04B 5/0421
USPC ..... 494/12, 16–21, 31, 33, 43, 81; 422/548
See application file for complete search history.

(56) References Cited

U.S. PATENT DOCUMENTS

| | | | | | |
|---|---|---|---|---|---|
| 3,752,390 | A * | 8/1973 | Chulay | 494/20 |
| 3,935,995 | A * | 2/1976 | Williams et al. | 494/20 |
| 3,997,105 | A * | 12/1976 | Hayden et al. | 494/20 |
| 4,400,166 | A * | 8/1983 | Chulay et al. | 494/20 |
| 4,585,433 | A * | 4/1986 | Cole | 494/20 |
| 4,585,434 | A * | 4/1986 | Cole | 494/20 |
| 4,586,918 | A * | 5/1986 | Cole | 494/20 |
| 4,589,864 | A * | 5/1986 | Cole | 494/20 |
| 5,496,255 | A * | 3/1996 | Chang | 494/20 |
| 6,699,168 | B2 * | 3/2004 | Hayward et al. | 494/20 |
| 2002/0035023 | A1 | 3/2002 | Miura et al. | |
| 2011/0183829 | A1 * | 7/2011 | Nemoto et al. | 494/20 |

FOREIGN PATENT DOCUMENTS

| | | | |
|---|---|---|---|
| JP | 48-33059 | | 10/1973 |
| JP | 57-62652 | U | 4/1982 |
| JP | 9-155237 | A | 6/1997 |
| JP | 2002-086016 | A | 3/2002 |
| JP | 2011083723 | A * | 4/2011 |
| JP | 2011147908 | A * | 8/2011 |
| JP | 2012024653 | A * | 2/2012 |

OTHER PUBLICATIONS

Japanese Office Action for the related Japanese Patent Application No. 2010-012812 dated Jan. 28, 2013.

* cited by examiner

*Primary Examiner* — Charles Cooley
(74) *Attorney, Agent, or Firm* — Kenealy Vaidya LLP

(57) ABSTRACT

A centrifugal separator comprising: a driving portion; and a swing rotor including, a rotor body, a through-hole passing through the rotor body, pin insert grooves which are provided parallel to the through-hole so as to oppose each other and only partially penetrate the rotor body, and a bucket including, a bucket body that has a contact surface which is configured to contact the rotor body during centrifugal separation, and a cap assembly that seals the bucket body and has a swing shaft extending in a direction perpendicular to an longitudinal direction of the bucket, wherein the swing rotor is rotated when the bucket is inserted into the through-hole, to swing the bucket, and the swing shaft can be moved in the longitudinal direction of the bucket relative to the bucket body and rotated about a longitudinal central axis of the bucket.

13 Claims, 7 Drawing Sheets

CENTRIFUGAL SEPARATOR AND SWING ROTOR FOR CENTRIFUGAL SEPARATOR

CROSS-REFERENCE TO RELATED APPLICATIONS

This application claims priority from Japanese Patent Application No. 2010-012812 filed on Jan. 25, 2010, the entire contents of which are incorporated herein by reference.

TECHNICAL FIELD

Aspects of the present invention relate to a centrifugal separator having a swing rotor, and more particularly, to a centrifugal separator and a swing rotor for a centrifugal separator, which are easily used and have a longer operating life by improving a bucket.

BACKGROUND

A centrifugal separator separates purifies a sample by inserting the sample (for instance, culture solution or blood or the like) into a rotor through a tube or a bucket vessel and rotating the rotor at high speed. A set rotating speed of the rotor is different depending on a use. Products from low speed (about several thousand rotations) to high speed (a maximum rotating speed is 150,000 rpm) are provided so as to meet uses. As rotors to be used, there are various kinds of rotors, for instance, an angle rotor whose tube hole is a fixed angle type so as to meet a high rotating speed or a swing rotor in which a bucket provided with a tube is swung from a vertical state to a horizontal state in accordance with the rotation of the rotor. Further, there are rotors of various sizes such as a rotor that is rotated at a super-high rotating speed to apply a high centrifugal acceleration to a small amount of sample or a rotor that is rotated at a low rotating speed but can treat a large amount of sample. Since these rotors are used depending on the sample to be separated, the rotors are detachably attached to a rotating shaft of a driving unit such as a motor and the rotor may be exchanged.

Generally, an allowable maximum rotating speed of the swing rotor is lower than that of the angle rotor, because the swing rotor has a swing mechanism. The bucket includes a bucket body and a hook portion formed in a cover portion of the bucket body. When the rotation is stopped, the hook portion is engaged with the arm to attach the bucket to the swing rotor. Further, FIGS. 8 and 9 shows related-art, where such structure for holding the bucket by using the hook portion is further improved.

FIG. 8 is an axially longitudinal sectional view of a related-art swing rotor 120. A left half of FIG. 8 shows a rotating state and a right half of FIG. 8 shows a stopping state. In a rotor body 21, four through portions 22 that pass thorough from an upper side to a lower side are provided at equal intervals in the circumferential direction. Buckets 130 are inserted into the through portions 22 from an upper side of the rotor body 21 to a lower side. In upper portions of the buckets 130, pins 134 are extended in directions perpendicular to the longitudinal directions of the buckets 130. Both end portions of the pins 134 abut on lower end portions (not shown in the drawing) of pin insert grooves 23, so that the buckets 130 do not slip out downward from the through portions 22 and are held at positions shown in the right half of FIG. 8. The buckets 130 do not come into contact with the rotor body 21, except for the pins 134. Further, lower end portions of the buckets 130 do not come into contact with a peripheral portion of a driving axial hole 28 of the rotor body 21.

Here, when the swing rotor 120 is rotated, the buckets 130 are swung by a centrifugal force on the pins 134, in the directions shown by an arrow mark 141 as swing shafts (rotating shafts) for a swing movement. In the swing movements of the buckets 130, the buckets 130 are moved from the vertical directions to horizontal directions (immediately transversely). In an outer peripheral side of the rotor body 21, hollow portions 24 are formed which are semi-cylindrically hollowed so as not to block the swing movements of the buckets 130 by the rotor body 21 at that time. The form of the hollow portion 24 may substantially correspond to an outer line of the bucket 130 and may be formed to be slightly larger than the bucket 130 so as to exactly fit the bucket 130 thereto.

The left half of FIG. 8 is a diagram showing a state that the bucket 130 is located in the horizontal direction by the centrifugal force. When the bucket 130 is swung upward until the bucket 130 is located in the horizontal direction, the centrifugal force operates so that the bucket 130 is directed outward in a longitudinal direction of the bucket. A flange portion 132*b* expanding in a radial direction of the bucket is formed in the bucket. At a higher rotating speed, a contact surface 132*a* formed in a lower portion of the flange portion 132*b* comes into contact with a bucket receiving surface 25 formed near an outer peripheral end portion of the hollow portion 24 at a position near an arrow mark 142. In such a way, when the rotating speed of the swing rotor 120 is increased to locate the bucket 130 in the horizontal direction and the centrifugal force of a prescribed level or higher is applied to the bucket 130, the centrifugal load of the bucket 130 is received not by the pin 134, but by the bucket receiving surface 25. Hereinafter, a state that the contact surface 132*a* of the bucket 130 effectively comes into contact with the bucket receiving surface 25 during a rotation at a sufficiently high rotating speed may be referred to as a "seated state" (The diagram of the left half in FIG. 8 shows a state immediately before the seated state, where the contact surface 132*a* does not contact the bucket receiving surface 25).

FIG. 9 is a development diagram showing an assembly structure of the related-art bucket 130. The bucket 130 is roughly formed of a cap assembly 131 and a bucket body 132. The bucket body 132 is a vessel for accommodating a tube in which a sample to be separated is put and is formed integrally therewith by scraping metal such as a titanium alloy having high specific strength. In the bucket body 132, a space is formed which corresponds to an outline of the tube and an opening portion 132*c* is formed for taking in and out the tube in an upper portion. In an inner peripheral side of the opening portion 132*c*, an internal thread is formed. Further, in a rather lower side of the opening portion 132*c* of the bucket body 132, the flange portion 132*b* that expands outwards in the radial direction of the bucket is formed. In the lower side of the flange portion 132*b*, the contact surface 132*a* is formed that comes into contact with the rotor body 21. The shape of the contact surface 132*a* is arbitrary. Here, the contact surface is formed so that the flange portion 132*b* is smoothly continuous to a lower portion whose diameter is small by a straight line portion and an R portion.

A cap main body 133 as a main portion of the cap assembly 131 serves as a cover for sealing an inner space of the bucket body 132 and is connected to the bucket body 132 by screwing. The cap main body 133 is manufactured, for instance, by scraping a metal alloy such as aluminum and includes a cover portion 133*c* serving as the cover, a cylindrical portion 133*a* formed in an upper portion of the cover portion 133*c* and an external threaded portion 133*d* formed in a lower portion of the cover portion 133*c*. The external threaded portion 133*d* is screwed to the internal threaded portion of the bucket body 132. In the cylindrical portion 133*a*, a through-hole 133*b* of an oval form in side view is formed through which the pin 134 transversely penetrates, so as to be vertically movable by a minute distance. The pin 134 is guided by the pin insert groove 23 of the rotor body 21 on both ends thereof and used to hold the bucket 130 on the rotor body 21 so as to swing freely.

A pin holder 135 is a member for attaching the pin 134 to the cap main body 133. When attaching the cap main body 133, the pin 134 and the pin holder 135, the pin holder 135 is initially inserted from an upper end of the cylindrical portion 133*a* of the cap main body 133. A central position of a through-hole 135*a* of the pin holder 135 is aligned with a central position of the through-hole 133*b* of the cap main body 133, and the pin 134 is press fitted in the through-hole 135*a* of the pin holder 135 from a side, so as to fix the cap main body and the pin holder. Here, the inside diameter of the pin holder 135 is formed with a little clearance so that the pin holder 135 may slide relative to the cylindrical portion 133*a* of the cap main body 133. Further, since the through-hole 133*b* formed in the cap main body 133 has the shape of a slot, the pin 134 can move vertically by a minute distance within a range of the through-hole 133*b*.

In an upper portion of the pin holder 135, one to several wave washers 136 are inserted and an upper portion thereof is fixed by a stopper 137. The stopper 137 is strongly pressed in and fixed to an upper end of the cylindrical portion 133*a* of the cap main body 133. The wave washer 136 is a spring member that urges downward the pin 134 and the pin holder 135 which are slightly vertically movable relative to the cap main body 133. When the bucket 130 is supported by both end portions of the pin 134, the pin holder 135 stands still at a position where a repulsion force of the wave washer 136 and a weight of the bucket 130 are balanced.

SUMMARY

Generally, when centrifugal separation is carried out by using the swing rotor, an allowable maximum rotating speed is lower than that when an angle rotor is used. However, a rotation at high speed is requested to the centrifugal separation using the swing rotor, and a centrifugal separator that uses the swing rotor and rotates the swing rotor at high speed such as 50,000 rpm has appeared. However, in the centrifugal separator using the swing rotor, there is a fear that, since a strong centrifugal load is applied to an attached bucket vessel by a rotating force of the rotor, when the swing rotor is repeatedly used, the strength of the bucket may be possibly lowered due to metal fatigue. Further, as recognized by experiments, when a state that the bucket is swung to be seated on a bucket receiving surface of the swing rotor is not stable, as the centrifugal load is increased, a force for rotating a pin may occasionally operate to fasten or unfasten a cap main body. Further, it is recognized that when the position of a bucket body which comes into contact with the bucket receiving surface of the swing rotor is always located at the same position, face pressure is repeatedly applied to a specific position. This is not preferable in view of operating life.

Aspects of the present invention are devised by considering the above-described background. Accordingly, it is an aspect the present invention to provide a centrifugal separator and a swing rotor for a centrifugal separator that can smoothly operate a swinging bucket and stably make the bucket seated.

Another aspect of the present invention is to provide a centrifugal separator and a swing rotor for a centrifugal separator that can be rotated at high speed by improving a bucket.

Another aspect of the present invention is to provide a centrifugal separator and a swing rotor for a centrifugal separator in which a position of a bucket body which comes into contact with a bucket receiving surface of the swing rotor can be prevented from being always located at the same position by improving a bucket, to realize long operating life.

According to an aspect of the present invention, there is provided a centrifugal separator comprising: a driving portion including a driving shaft; and a swing rotor provided at an end of the driving shaft, the swing rotor including, a rotor body, a through-hole passing through the rotor body from an upper side in an axial direction of the driving shaft, pin insert grooves which are provided to the through-hole parallel with the axial direction of the driving shaft, the pin insert grooves opposing each other in a diametric direction of the through-hole and only partially penetrating the rotor body, a cut-out portion perpendicular to the through-hole and formed outwards in a radial direction of the driving shaft, and a bucket including, a bucket body that accommodates a vessel and has a contact surface which is configured to contact the rotor body during centrifugal separation, and a cap assembly that seals the bucket body and has a swing shaft extending in a direction perpendicular to an longitudinal direction of the bucket, wherein the swing rotor is rotated when the bucket is inserted into the through-hole, to swing the bucket, and the swing shaft can be moved in the longitudinal direction of the bucket relative to the bucket body and rotated about a longitudinal central axis of the bucket.

According to another aspect of the present invention, there is provided a swing rotor for a centrifugal separator, the swing rotor comprising: a rotor body; and a bucket including, a bucket body that accommodates a vessel and has a contact surface which is configured to contact the rotor body during centrifugal separation, and a cap assembly that seals the bucket body and has a swing shaft extending in a direction perpendicular to an longitudinal direction of the bucket, wherein the swing shaft can be moved in the longitudinal direction of the bucket relative to the bucket body and rotated about a longitudinal central axis of the bucket.

DETAILED DESCRIPTION

First Exemplary Embodiment

Figure 1:
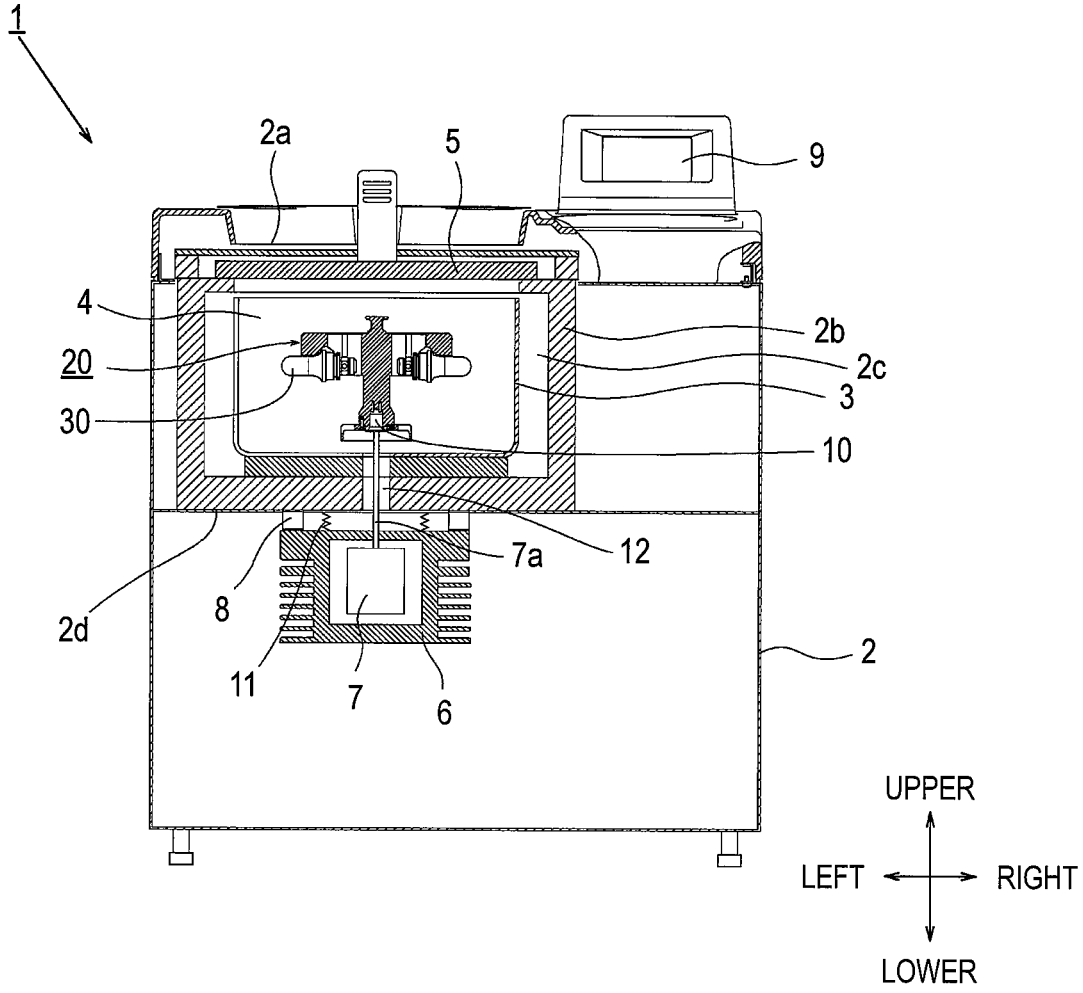
FIG. 1 is a sectional view showing a structure of a centrifugal separator 1 according to an exemplary embodiment of the present invention.

Hereinafter, an exemplary embodiment of the present invention will be described by referring to the drawings. In the drawings, the same portions are designated by the same reference numerals and repeated explanation is omitted. Further, upper and lower directions described hereinafter correspond to upper and lower arrows shown in the drawings.

FIG. 1 is a sectional view showing a structure of a centrifugal separator 1 according to the exemplary embodiment of the present invention. The centrifugal separator 1 includes a protective wall 2*b* in a box shaped casing 2 manufactured by a plate or plastic. A chamber 2*c* is defined by the protective wall 2*b* and a door 5. The chamber 2*c* is sealed by a packing not shown in the drawing. In the chamber 2*c*, a bowl 3 is provided. In an inner space of the bowl 3 (a rotor chamber 4), a swing rotor 20 is provided that holds a sample to be separated and rotates at high speed. In FIG. 1, a state is shown that the swing rotor 20 rotates at high speed and buckets 30 are swung and located in horizontal positions. In the present exemplary embodiment, the swing rotor 20 rotates at speed, for instance, from about 30,000 rpm to about 60,000 rpm. The swing rotor 20 is attached to a driving shaft portion 10 provided at an end of a rotating shaft 7*a* protruding to the chamber 2*c*.

The swing rotor 20 includes a rotor body and a plurality of buckets 30 into which tubes having accommodated samples to be separated are inserted. By the rotation and centrifugal force of the swing rotor 20, the buckets 30 are swung in the centrifugal direction to be located in horizontal directions from vertical directions. The form of the swing rotor will be described hereinafter. The swing rotor 20 is rotated by a motor 7 included in a driving portion 6. The rotation of the motor 7 is controlled by a controller not shown in the drawing. The driving portion 6 is attached to a lower side of a partition plate 2*d* of the casing 2 via a damper 8.

The chamber 2*c* is formed so as to be sealed by the door 5. Under a state that the door 5 is opened, the swing rotor 20 can be attached to or detached from the rotor chamber 4 in the chamber 2*c* through an opening portion 2*a* in an upper side. Though not shown in the drawing, a cooling device that maintains an inner portion of the rotor chamber 4 at a desired low temperature and a vacuum pump that maintains an inner portion to a prescribed pressure reduced state is connected to the chamber 2*c*. During the operation of a centrifugal separation, an inner portion of the rotor chamber 4 is maintained in a set environment by a control by the controller. In a side portion (a right side) of the door 5, an operation and display portion 9 is arranged, in which a user inputs conditions such as a rotating speed of the rotor or a centrifugal separation time, and on which various kinds of information is displayed. The operation and display portion 9 is formed with, for instance, a combination of a liquid crystal display device and operating buttons or a touch type liquid crystal panel. Further, between the driving portion 6 and a lower portion of the protective wall 2*b*, a bellows 11 is provided so as to surround the rotating shaft 7*a*. Thus, when the pressure in the chamber 2*c* is reduced by the vacuum pump not shown in the drawing, atmospheric air is prevented from entering from a through-hole 12 through which the rotating shaft 7*a* passes.

Figure 2:
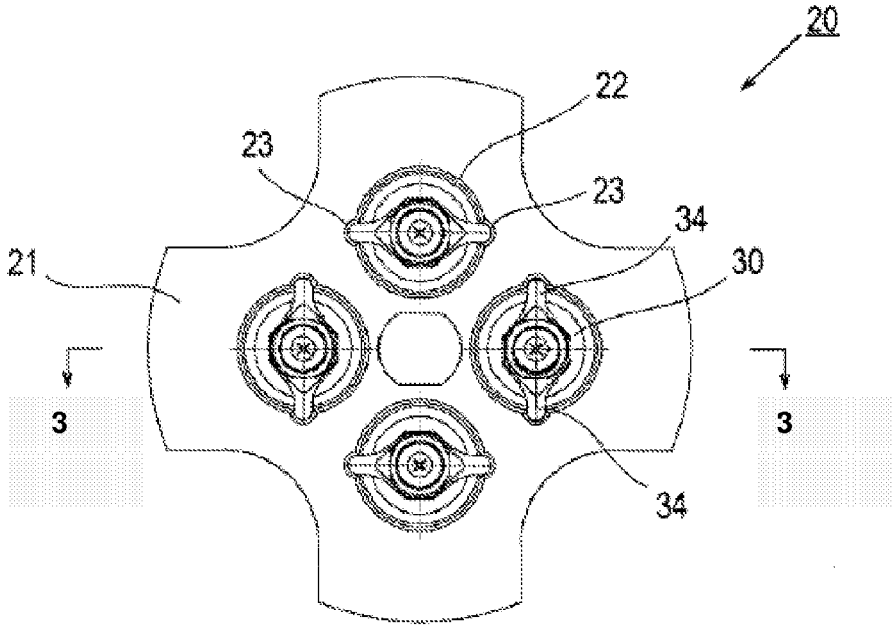
FIG. 2 is a top view of a swing rotor 20 in FIG. 1.

FIG. 2 is a top view of the swing rotor 20. FIG. 2 shows a state that the buckets 30 are respectively inserted into through portions 22. The swing rotor 20 of the present exemplary embodiment has a substantially cross form when seen from the upper side and includes the rotor body 21 having a diameter of about 130 mm to 150 mm and the buckets 30 inserted into the four through portions 22. The through portions 22 are cylindrical holes provided at equal intervals of 90° in the circumferential direction and passing through the rotor body 21 from the upper side to the lower side. Pin insert grooves 23 are formed at two opposed positions about 180° spaced in a diametric direction of an inner wall of the through portion. The pin insert grooves 23 are formed to hold both end portions of pivot pins 34 of the bucket 30 and axially extended from an upper opening of the through portion 22 to an axially lower portion, however, do not reach a lower opening. In other words, the pin insert grooves 23 only partially penetrate the rotor body 21. Accordingly, when the bucket 30 is inserted downward from the upper side of the through portion 22, both the sides of the pivot pins 34 are held in the lower end portions of the pin insert grooves 23.

The rotor body 21 may be formed substantially in a circular shape when the rotor body is seen from the upper side. However, in order to reduce a mass of the swing rotor 20, the swing rotor is formed to decrease a thickness except for portions that a below-described bucket accommodating space 29 (see FIG. 3) and the through portions 22 are formed. In the bucket 30, the pivot pins 34 are formed to extend in opposite directions to each other in the same straight line. The pivot pins 34 are guided by the pin insert grooves 23 so that the bucket 30 is attached to the through portion 22. A diameter of a circular hole of the through portion 22 is formed to be larger than an outside diameter of the bucket 30. However, the bucket 30 is held by the pivot pins 34 so as not to slip out downward from the through portion 22. Further, since a swing direction of the bucket 30 is a radial direction on the pivot pins 34 when the bucket is seen from the upper side, extending directions of the pivot pins 34 are arranged so as to correspond to tangential lines of a circle passing the centers of rotation of the four buckets 30.

Figure 3:
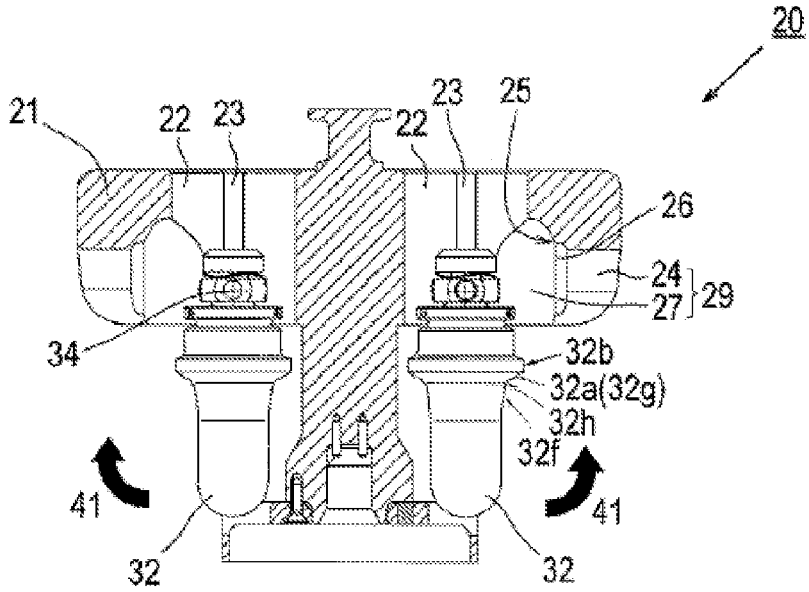
FIG. 3 is a sectional view taken along a line 3-3 in FIG. 2.

FIG. 3 is a sectional view taken along a line 3-3 in FIG. 2 (However, the bucket 30 is not shown in a sectional view, but in a side view). FIG. 3 shows a state that the swing rotor 20 is stopped and a longitudinal direction of the bucket 30 is in a vertical direction. Since both the end portions of the pivot pins 34 abut on the lower end portions (not shown in the drawing) of the pin insert grooves 23, the bucket 30 does not slip out downward from the rotor body 21 and is held in a position as illustrated in FIG. 3. At this time, the bucket 30 does not come into contact with the rotor body 21, except for the pivot pins 34. A lower end portion of the bucket 30 does not come into contact with any portions of the swing rotor 20. When the motor 7 (see FIG. 1) is started from this state to rotate the swing rotor 20, the bucket 30 is swung in the direction shown by an arrow mark 41 by a centrifugal force, the pivot pins 34 serving as rotating shafts for the swing movement. The swing movement of the bucket 30 continues until the bucket 30 is moved in a horizontal direction (immediately lateral). In the rotor body 21, the bucket accommodating space 29 (a space formed by a hollow portion 24 which is semi-cylindrically hollowed and a bucket accommodating cavity 27) is formed so as not to block the swing movement of the bucket 30 by the rotor body 21 at that time. The bucket accommodating cavity 27 is formed in the vicinity of a connecting portion of the through portion 22 to the hollow portion 24. The bucket accommodating space 29 is a space formed to prevent the bucket 30 from coming into contact with the rotor body 21 when the bucket 30 is swung, except for a specific portion.

In an upper portion of a bucket body 32, a flange portion 32*b* expanding in the diametric direction is formed. A contact surface 32*a* which comes into contact with the rotor body 21 is formed to a lower portion of the flange portion 32*b*. The contact surface 32*a* is formed with a linear inclined surface 32*g* continuous in a circumferential direction and extending to a lower tapered portion 32*f*, which will be described later, from the flange portion 32*b*. The inclined surface is connected to the tapered portion 32*f* by an R portion 32*h*. On the other hand, in the vicinity of the connecting portion of the bucket accommodating cavity 27 and the hollow portion 24 of the rotor body 21, a bucket receiving surface 25 is formed which effectively comes into contact with the contact surface 32*a*. Further, a clearance groove 26 is formed adjacently to the bucket receiving surface 25. The clearance groove 26 is a corner removed portion or cut-out portion so that when the bucket 30 is swung to be located in a horizontal position or the bucket receiving surface 25 comes into contact with the contact surface 32*a*, the R portion 32*h* of the bucket body 32 does not collide with the corners of the bucket accommodating cavity 27 and the hollow portion 24.

Figure 4:
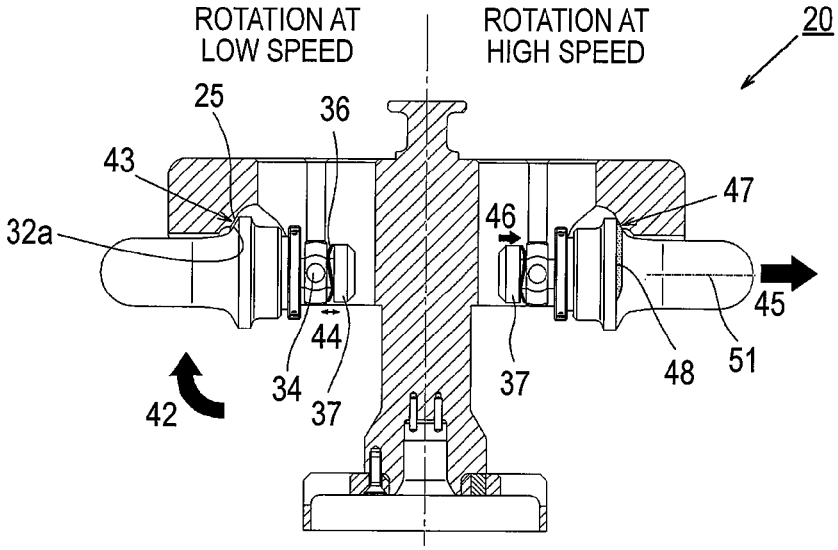
FIG. 4 is an axial longitudinal sectional view of the swing rotor 20 during rotation, where a left half shows a state during the rotation at low speed and a right half shows a state during the rotation at high speed.

FIG. 4 is a sectional view of the swing rotor 20 during rotation. A left side of FIG. 4 shows a state during the rotation at low speed (for instance, about 500 to 1,500 rpm), immediately after the bucket 30 is swung to be located in the horizontal direction. A right side of FIG. 4 shows a state when the swing rotor is rotated at a set rotating speed which is high speed. As the rotating speed of the swing rotor 20 increases, the bucket 30 swings as shown by an arrow mark 42, the pivot pins 34 being centers of the swing. When the rotating speed reaches a prescribed rotating speed, the bucket 30 is located in the horizontal position as shown in the left side of FIG. 4. In such a way, at the low rotating speed immediately after the bucket is located in the horizontal position, since a centrifugal load applied to the bucket 30 is not so high, the bucket receiving surface 25 does not come into contact with the contact surface 32*a* as shown by an arrow mark 43, due to an operation of a wave washer 36. Especially, in the swing rotor 20 according to the present exemplary embodiment, when the bucket 30 is swung from the vertical position to the horizontal position, since the bucket 30 does not come into contact with any portions of the swing rotor 20, the bucket 30 can be swung smoothly. The wave washer 36 urges the pivot pins 34 to be separated from a stopper 37 so as to increase a clearance between the pivot pins 34 and the stopper 37. Accordingly, under a state that a large centrifugal load is not applied to the bucket 30, a force of the wave washer 36 operates to urge the contact surface 32*a* to be separated from the bucket receiving surface 25.

When the rotating speed of the swing rotor 20 is increased from the state that the bucket 30 is located in the horizontal position, since a strong centrifugal load is applied to the bucket 30 in the direction shown by an arrow mark 45, the wave washer 36 is bent as shown in the right side of the drawing to move the bucket 30 outwards in the longitudinal direction thereof and decrease a clearance between the rotor body 21 and the bucket 30. As a result, the bucket body 32 and the stopper 37 are moved in the direction shown by an arrow mark 46 to reduce the thickness of the wave washer 36, and at a position shown by an arrow mark 47, the contact surface 32*a* effectively comes into face contact with the bucket receiving surface 25 to be seated thereon. The rotating speed when the contact surface 32*a* is seated on the bucket receiving surface 25 is, for instance, about 3000 rpm. The area of the bucket that face contacts the bucket receiving surface 25 is shown by a contact area 48, which is substantially half of an upper side of the contact surface 32*a* of the bucket 30. In such a way, when the rotating speed of the swing rotor 20 is sufficiently high, the centrifugal load of the bucket 30 is received by a wide area of the bucket receiving surface 25 formed in the rotor body 21. Thus, the centrifugal load applied to the bucket portion 30 does not act on the pivot pins 34. In the present exemplary embodiment, even when the bucket 30 is located in the horizontal position, the pivot pins 34 are not restrained from not only moving in the direction of a bucket central axis 51 (a longitudinal direction), but also moving in the direction of rotating about the bucket central axis 51.

As described above, since a degree of freedom of the pivot pins 34 is increased relative to a body portion of the bucket 30, even if the centrifugal load may be increased so that the bucket 30 is swung not in an ideal state, but in a slightly obliquely twisted state and one side of the body portion of the bucket 30 may possibly initially abut on the bucket receiving surface 25, load is not applied to the pivot pins 34. That is, even when the load is occasionally applied to the pivot pins 34, the pivot pins 34 are rotated in the axial direction or in the rotating direction so that such a load may be avoided from being applied to the pivot pins 34. As a result, the bucket 30 is not restrained by the pivot pins 34 and can be guided to a position where the contact surface 32*a* effectively comes into face contact with the bucket receiving surface 25.

Figure 5:
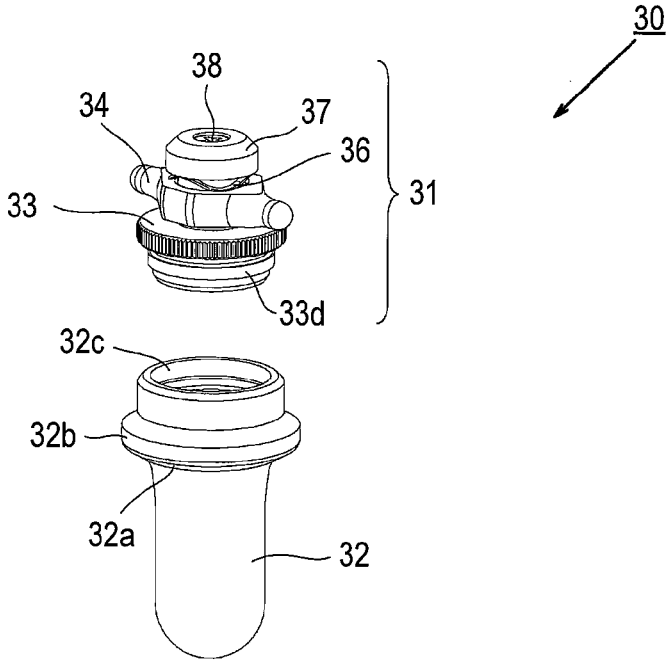
FIG. 5 is a perspective view showing the form of an external appearance of a bucket 30 according to the exemplary embodiment of the present invention, and shows a state that a cap assembly 31 is detached from a bucket body 32.
Figure 8:
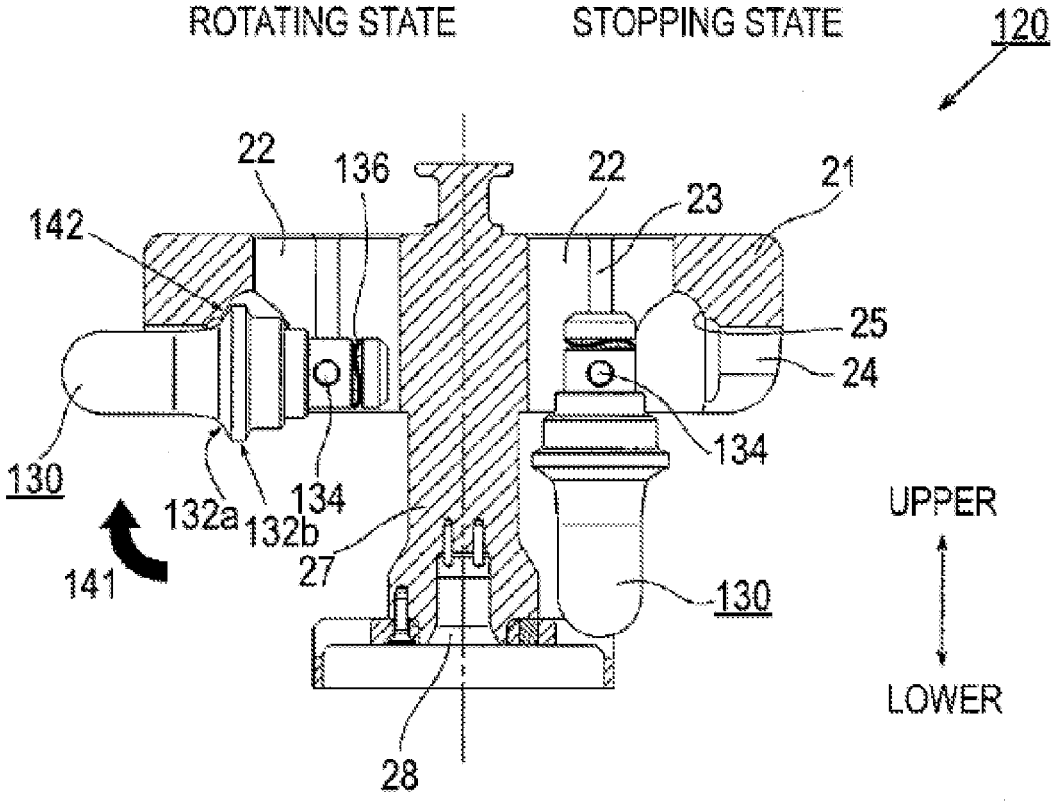
FIG. 8 RELATED ART
FIG. 8 is an axially longitudinal sectional view of a related-art swing rotor 120, where a left half shows a rotating state and a right half shows a stopping state.
Figure 9:
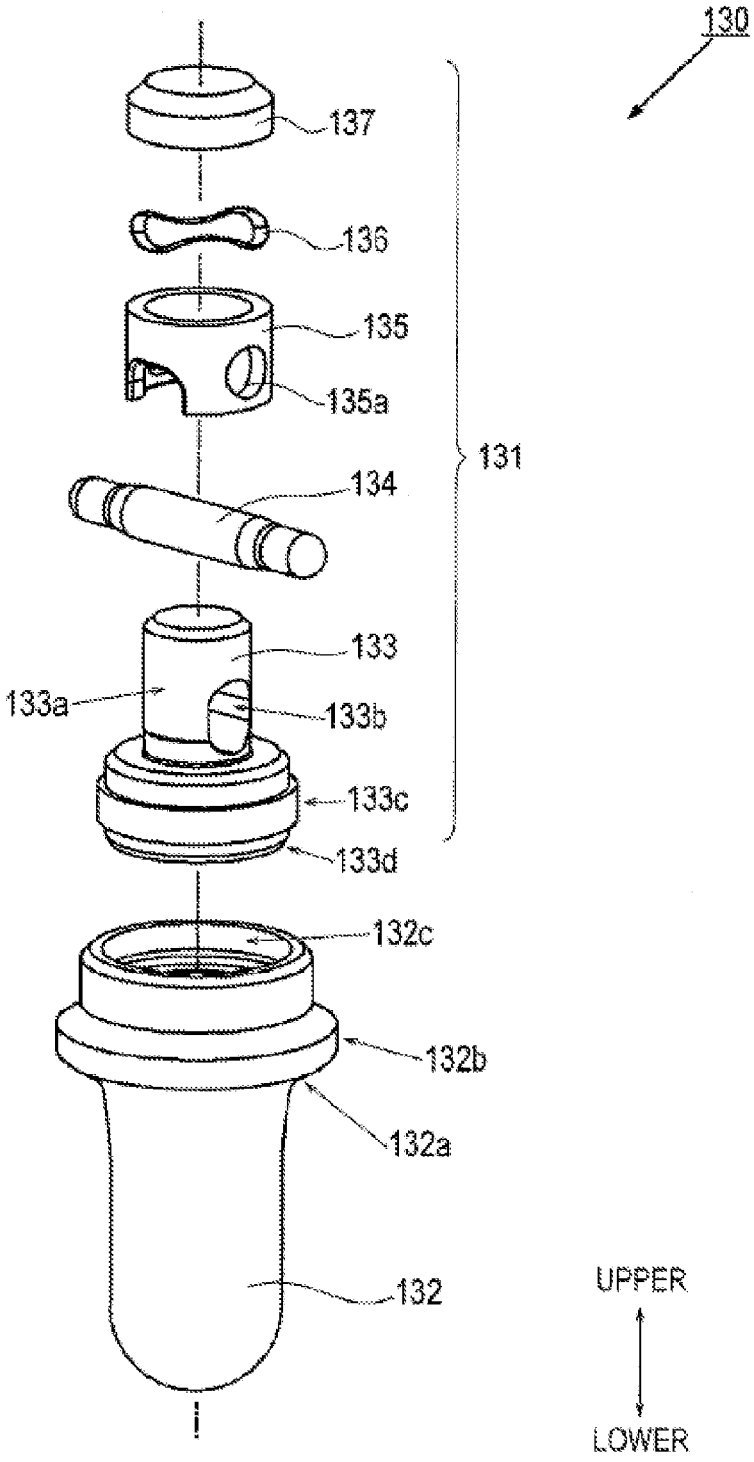
FIG. 9 RELATED ART
FIG. 9 is a development diagram showing an assembled structure of a related-art bucket 130.

Hereinafter, detailed structure of the bucket 30 will be described by referring to FIGS. 5 to 7. FIG. 5 is a perspective view showing an external appearance of the bucket 30 according to the exemplary embodiment of the present invention and showing a state that a cap assembly 31 is detached from the bucket body 32. Here, although the bucket body 32 is designated by a different reference numeral as compared to the bucket body 132 shown in FIGS. 8 and 9, the bucket body 32 has absolutely the same configuration as that of the bucket body 132. Thus, these bucket bodies may be exchanged between each other. The bucket body 32 is a vessel for accommodating a tube in which a sample to be separated is put and is formed integrally by scraping metal such as a titanium alloy which has high specific strength. In the bucket body 32, a space is formed which corresponds to an outline of the tube and an opening portion 32*c* for taking in and out the tube is formed in an upper portion. In an inner peripheral side of the opening portion 32*c*, an internal thread is formed. Further, in a rather lower portion of an outer peripheral side from the opening portion 32*c* of the bucket body 32, the flange portion 32*b* that expands in the radial direction of the bucket 30 is formed. In the lower side of the flange portion 32*b*, the contact surface 32*a* is formed which is continuous in the circumferential direction so as to come into contact with the bucket receiving surface 25 of the rotor body 21. The form of the contact surface 32*a* is arbitrary. In the exemplary embodiment, as shown in FIG. 3, the contact surface is formed with the linear inclined surface 32*g* extending to the lower tapered portion 32*f*, which will be described later, from the flange portion 32*b*.

A cap main body 33 as a main portion of the cap assembly 31 serves as a cover for sealing an inner space of the bucket body 32 and is attached to the opening portion 32*c* of the bucket body 32 by screwing. The cap main body 33 is manufactured, for instance, by scraping a metal alloy such as aluminum, and has an external threaded portion 33*d* formed in a lower portion which is screwed to the internal threaded portion of the bucket body 32. In an upper portion of the cap main body 33, the pivot pins 34 are provided which are inserted into the pin insert grooves 23 formed in the swing rotor 20. In an upper portion of the pivot pins 34, one or more wave washers 36 are inserted and the stopper 37 is attached from an upper portion thereof. In the present exemplary embodiment, three wave washers 36 are inserted. The number of the wave washers 36 may be suitably set by considering the maximum rotating speed of a centrifugal separation or the weight of the bucket. At a central portion of the stopper 37, a screw-hole is opened and the stopper is fixed to the cap main body 33 by a screw 38. The pivot pins 34 are supported so that the pivot pins may be rotated about the bucket central axis 51 (a longitudinal central axis: a longitudinal direction of the screw 38) of the bucket 30. In the cap assembly 31 of the present exemplary embodiment, since the pivot pins 34 rotate about the bucket central axis 51, which is different from the cap assembly 131 of the related-art shown in FIG. 9, the cap assembly 31 cannot be fastened or unfastened relative to the bucket body 32 by using the pivot pins 34. Thus, in the present exemplary embodiment, an outer peripheral edge of the cap main body 33 has many grooves to be notched. This portion having many grooves serves as a knob portion for rotating the cap assembly 31.

Figure 6:
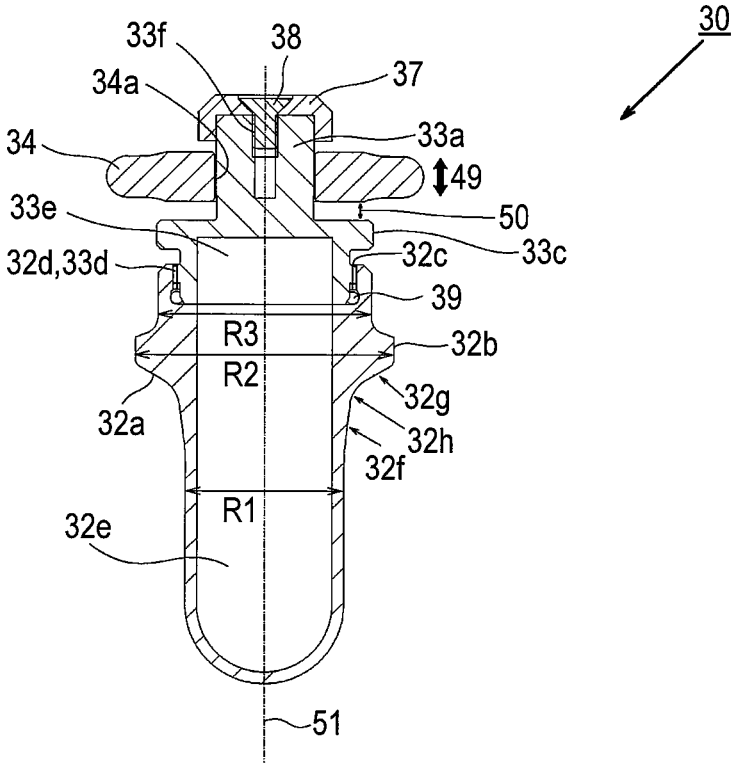
FIG. 6 is a longitudinal sectional view of the bucket 30 according to the exemplary embodiment of the present invention.

FIG. 6 is a longitudinal sectional view of the bucket 30. In the inner portion of the bucket body 32, an inner space 32*e* is formed for accommodating the tube in which the sample to be separated is put. In the bucket body 32, the flange portion 32*b* of a diameter of R2 which expands in the radial direction of the bucket 30 is formed relative to a basic cylindrical portion of a diameter of R1, and a portion of a diameter of R3 is formed in an upper portion of the flange portion 32*b*. An internal threaded portion 32*d* is formed in the portion of the diameter R3, and a hollow circle ring 39 is provided lower to the internal threaded portion 32*d*. The diameter R3 is a little bit larger than the diameter R1. In the present exemplary embodiment, for instance, R1 is about 20 mm, R2 is about 31 mm and R3 is about 26 mm. Further, the tapered portion 32*f* that expands in the radial direction of the bucket 30 to the inclined surface 32*g* is formed from the portion of the diameter of R1.

The hollow circle ring 39 contacts an outer circumferential surface of a cylindrical hollow portion provided lower to an external threaded portion 33*d*, which will be described later, of the cap main body 33, so as to seal the inner space 32*e*. A threaded portion is not formed to the outer circumferential surface of the cylindrical hollow portion to which the hollow circle ring 39 contacts.

The cap main body 33 includes a cover portion 33*c* serving as the cover, a cylindrical portion 33*a* formed in an upper portion of the cover portion 33*c* and a cylindrical hollow portion 33*e* formed in a lower portion of the cover portion 33*c*. The external threaded portion 33*d* is formed in an outer peripheral portion of the cylindrical form. At a center of an upper portion of the cylindrical portion 33*a*, a screw-hole 33*f* is formed and the stopper 37 is fixed to the cylindrical portion 33*a* by the screw 38. In FIG. 6, an illustration of the wave washers 36 is omitted. The wave washers 36 are arranged above the pivot pins 34 and below the stopper 37. The thickness of the pivot pin 34 is adequately smaller than a distance between the stopper 37 and the cover portion 33*c*. As shown in FIG. 6, in an upper side of the pivot pins 34, a clearance of about 2 mm is provided for arranging the wave washers 36, and in a lower side of the pivot pins 34, a clearance of about 2 mm is formed as shown by an arrow mark 50. Accordingly, the pivot pins 34 can be moved by a minute distance in the direction shown by an arrow mark 49.

Figure 7:
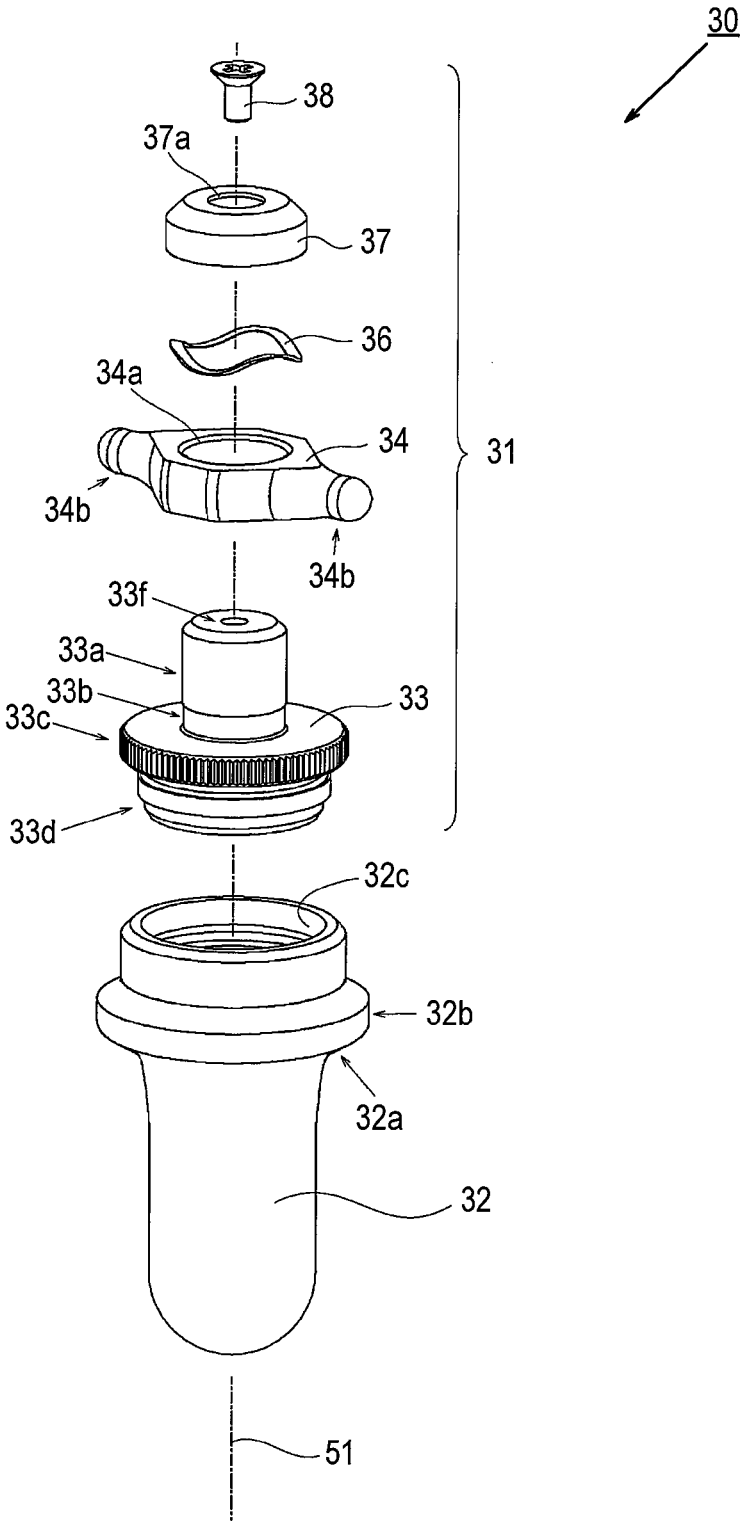
FIG. 7 is a development diagram showing an assembled structure of the bucket 30 according to the exemplary embodiment of the present invention.

FIG. 7 is a development diagram showing an assembled structure of the bucket 30. The cap main body 33 as the main portion of the cap assembly 31 is attached to the bucket body 32 by screwing. The cap main body 33 includes the cover portion 33*c* serving as the cover, the cylindrical portion 33*a* formed in the upper portion of the cover portion 33*c* and the external threaded portion 33*d* formed in the lower portion of the cover portion 33*c*. In the outer peripheral portion of the cover portion 33*c*, the notched grooves are formed to rotate the cap assembly 31. In the vicinity of a connecting portion of an upper surface of the cover portion 33*c* to a lower portion of the cylindrical portion 33*a*, a clearance groove portion 33*b* is formed whose diameter is reduced. The clearance groove portion 33*b* is formed so as to easily manufacture the cap main body 33 by scraping the metal. The clearance groove portion 33*b* need not be provided.

The pivot pin 34 are manufactured by scraping metal such as a titanium alloy and two shaft portions 34 *b* are formed which extend outward from an annular member having a through-hole 34 *a*. The shaft portions 34*b* serve as swing shafts. The directions in which the shaft portions 34*b* are extended are located on one straight line, opposite to each other and perpendicular to the bucket central axis (the longitudinal central axis) 51 of the bucket 30. An inside diameter of the through-hole 34 *a* formed in the pivot pin 34 is formed to be a little larger than an outside diameter of the cylindrical portion 33 *a* so that the pivot pin 34 may be smoothly rotated relative to the cap main body 33 and may be moved in the longitudinal direction of the bucket 30. As exemplified in FIG. 7, the diameter of rotating cover portion 33*c* is smaller than the length of the two shaft portions 34*b* in the shaft direction and larger than the diameter of the annular member having through-hole 34*a*.

In an upper portion of the pivot pin portions 34, one to several wave washers 36 are inserted and the stopper 37 is fixed to an upper portion thereof. The stopper 37 has a through-hole 37*a* and a screw portion of the screw 38 passing through the through-hole 37*a* is screwed to the screw-hole 33*f* formed on an upper end of the cylindrical portion 33*a* of the cap main body 33 to fix the stopper. In such a way, the pivot pin portions 34 are prevented from slipping out by the stopper 37 attached to the terminal end of the cylindrical portion 33*a* through the wave washers 36.

In the present exemplary embodiment, since the pivot pin portions 34 serving as the swing shafts can be longitudinally moved relative to the bucket body 32 and rotated about the bucket central axis 51, the degree of freedom of the movement of the pivot pin portions 34 relative to the bucket body 32 can be increased. As a result, since a torsional torque is not transmitted to the cap assembly 31 from the pivot pin portions 34, in the bucket for the swing rotor of a structure in which the weight of the bucket is supported by the rotor body during a rotation at high speed, the structure, in which the fastening of the cap assembly is not influenced even when an abutment of a seated surface of the bucket is nonuniform, is realized.

Further, since an unfastening operation or a tightening operation is not applied to the screw portion of the cap assembly 31 during a centrifugal separation, even when the cap assembly 31 is fastened to the bucket body 32 by the screw, it can be avoided that the cap assembly 31 is unfastened or the cap assembly 31 is difficult to be detached from the bucket body 32 due to the tightening operation, after the centrifugal separating operation. Further, in the cap assembly having an elastic body (the wave washer) to ensure a prescribed clearance between the rotor body and the bucket while the bucket is swung to be seated on the rotor body, the same function can be achieved by using five portions compared to six portions used in a related-art product. That is, the same function can be achieved by a smaller number of portions compared to that of the related-art product. Thus, a product having the same quality as that of the related-art product can be manufactured by lower cost.

EFFECTS OF THE INVENTION

According to the above-described disclosure, about a centrifugal separator including a bucket which can be swung on a swing shaft and having a contact surface which contacts a rotor body during centrifugal separation, since the swing shaft can be moved in a longitudinal direction of the bucket relative to a bucket body and rotated by a prescribed angle or more about a longitudinal central axis of the bucket, the flexibility of a pivot pin that moves relative to the bucket body can be increased. As a result, even when a centrifugal load is increased so that the bucket is swung not in an ideal state, but in a slightly obliquely twisted state, the bucket is not restrained by the pivot pin and can be guided to a position where the contact surface effectively comes into face contact with a bucket receiving surface.

Further, according to the above-described disclosure, since the swing shaft can be rotated by a prescribed angle or more about the longitudinal central axis of the bucket relative to the bucket body, a position of the bucket body that comes into contact with the bucket receiving surface of the swing rotor can be distributed. Thus, the operating life of the bucket can be greatly extended.

Further, according to the above-described disclosure, since the swing shaft can be continuously rotated about the longitudinal central axis of the bucket, relative to the bucket body, a position of the bucket body that comes into contact with the bucket receiving surface of the swing rotor is not the same. Thus, the operating life of the bucket can be greatly extended.

Further, according to the above-described disclosure, since a cap assembly is provided with a rotating portion for rotating the cap assembly relative to the bucket body, the cap assembly can be easily fastened or unfastened relative to the bucket body by rotating the rotating portion, without using the swing shaft.

Further, according to the above-described disclosure, since the swing shaft has two shaft portions extending in opposed directions from an annular member, and the cylindrical portion penetrates the annular member so as to support the swing shaft, the swing shaft can be easily manufactured and has a sufficient strength. Further, in an assembling operation of the bucket, a work such as a pressing-in operation is not necessary, so that the bucket can be easily assembled.

Further, according to the above-described disclosure, since a wave washer is arranged in an upper side of the swing shaft, and, a stopper member that fixes the swing shaft and the wave washer to the cylindrical portion is provided to an upper side of the wave washer, the bucket body can be held so as not to come into contact with the swing rotor during a swing operation by an urging operation of the wave washer. Thus, the swing operation can be smoothly carried out.

Further, according to the above-described disclosure, since an external threaded portion is formed in a lower portion of the cover portion, an internal threaded portion is formed in an inner peripheral side of the opening portion of the bucket body and the cap assembly is screwed to the bucket body with an hollow circle ring sandwiched therebetween, an inside of the bucket rotated under a pressure reduced condition can be sealed from external. Thus, a sample can be prevented from leaking from the bucket.

The present invention has been described in accordance with the exemplary embodiment. However, the present invention is not limited to the above-described exemplary embodiment, and various changes may be made therein without departing form the spirit and scope of the invention. For instance, an attaching method of the pivot pin to the cap main body is not limited to the method described in the exemplary embodiment. If a pivot pin is formed so as to move in the longitudinal direction of the bucket body and rotate by a prescribed angle or more about the bucket central axis, other arbitrary structures or attaching methods may be employed.

What is claimed is:

1. A centrifugal separator comprising:

a driving portion including a driving shaft; and a swing rotor provided at an end of the driving shaft, the swing rotor including, a rotor body, a through-hole passing through the rotor body from an upper side in an axial direction of the driving shaft, pin insert grooves which are provided to the through-hole parallel with the axial direction of the driving shaft, the pin insert grooves opposing each other in a diametric direction of the through-hole and only partially penetrating the rotor body, a cut-out portion perpendicular to the through-hole and formed outwards in a radial direction of the driving shaft, and a bucket including, a bucket body that accommodates a vessel and has a contact surface which is configured to contact the rotor body during centrifugal separation, and a cap assembly that seals the bucket body and has a swing shaft extending in a direction perpendicular to a longitudinal direction of the bucket, wherein the swing rotor is rotated when the bucket is inserted into the through-hole, to swing the bucket, wherein the cap assembly includes:

a rotating portion for rotating the cap assembly relative to the bucket body;

a cylindrical portion provided above the rotating portion in the longitudinal direction; and an external threaded portion which can be screwed to an internal threaded portion formed to the bucket body;

wherein the swing shaft includes:

an annular member including a through-hole through which the cylindrical portion penetrates; and two shaft portions extending in opposed directions from the annular member, wherein a stopper member that prevents the swing shaft from dropping out of the cylindrical portion is provided to the cylindrical portion, wherein the swing shaft is supported by the cylindrical portion, and can be moved in the longitudinal direction of the bucket relative to the bucket body and rotated about a longitudinal central axis of the bucket, and wherein a diameter of the rotating portion is smaller than a length between distal ends of the two shaft portions in the shaft direction and larger than an outer diameter of the annular member.

2. The centrifugal separator according to claim 1, wherein the swing shaft can be rotated by a prescribed angle or more about the longitudinal central axis of the bucket, relative to the bucket body.

3. The centrifugal separator according to claim 2, wherein an outer peripheral portion of the rotating portion includes a plurality of notched thin vertical grooves for rotating the cap assembly.

4. The centrifugal separator according to claim 2, wherein a screw hole is formed to a center of an upper portion of the cylindrical portion, and the stopper member is fixed to the cylindrical portion by a screw.

5. The centrifugal separator according to claim 1, wherein the swing shaft can be continuously rotated about the longitudinal central axis of the bucket, relative to the bucket body.

6. The centrifugal separator according to claim 1, wherein a clearance groove portion whose diameter is reduced is formed to a lower portion of the cylindrical portion which is in the vicinity of a portion of the cylindrical portion that connects with an upper surface of the rotating portion.

7. The centrifugal separator according to claim 1, wherein the rotating portion is provided below the swing shaft.

8. A swing rotor for a centrifugal separator, the swing rotor comprising:

a rotor body; and a bucket including, a bucket body that accommodates a vessel and has a contact surface which is configured to contact the rotor body during centrifugal separation, and a cap assembly that seals the bucket body and has a swing shaft extending in a direction perpendicular to a longitudinal direction of the bucket, wherein the cap assembly includes:

a rotating portion for rotating the cap assembly relative to the bucket body;

a cylindrical portion provided above the rotating portion in the longitudinal direction; and an external threaded portion which can be screwed to an internal threaded portion formed to the bucket body;

wherein the swing shaft includes:

an annular member including a through-hole through which the cylindrical portion penetrates; and two shaft portions extending in opposed directions from the annular member, wherein a stopper member that prevents the swing shaft from dropping out of the cylindrical portion is provided to the cylindrical portion, wherein the swing shaft is supported by the cylindrical portion, and can be moved in the longitudinal direction of the bucket relative to the bucket body and rotated about a longitudinal central axis of the bucket, and wherein a diameter of the rotating portion is smaller than a length between distal ends of the two shaft portions in the shaft direction and larger than an outer diameter of the annular member.

9. A swing rotor for a centrifugal separator according to claim 8, wherein the swing shaft can be rotated by a prescribed angle or more about the longitudinal central axis of the bucket, relative to the bucket body.

10. A swing rotor for a centrifugal separator according to claim 9, wherein a wave washer is arranged in an upper side of the swing shaft, and wherein the stopper member is provided to an upper side of the wave washer and fixes the wave washer to the cylindrical portion.

11. A swing rotor for a centrifugal separator according to claim 9, wherein the cap assembly is screwed to the bucket body with a hollow circle ring sandwiched therebetween.

12. A swing rotor for a centrifugal separator according to claim 8, wherein the swing shaft can be continuously rotated about the longitudinal central axis of the bucket, relative to the bucket body.

13. The centrifugal separator according to claim 8, wherein the rotating portion is provided below the swing shaft.

* * * * *